US006552314B2

(12) United States Patent
Fukushima et al.

(10) Patent No.: US 6,552,314 B2
(45) Date of Patent: Apr. 22, 2003

(54) NORMAL POSITION DETECTING AND LATCHING MECHANISM OF A FUNCTIONAL COMPONENT IN A HEATING APPARATUS

(75) Inventors: Kei Fukushima, Tsurugashima (JP); Hiroshi Matsuo, Tsurugashima (JP)

(73) Assignee: Fujimak Corporation, Tokyo (JP)

( * ) Notice: Subject to any disclaimer, the term of this patent is extended or adjusted under 35 U.S.C. 154(b) by 0 days.

(21) Appl. No.: 09/833,877

(22) Filed: Apr. 12, 2001

(65) Prior Publication Data

US 2001/0032841 A1 Oct. 25, 2001

(30) Foreign Application Priority Data

Apr. 20, 2000 (JP) ..... 2000-119075

(51) Int. Cl.[7] ..... H05B 6/68; H05B 6/76

(52) U.S. Cl. ..... 219/723; 219/722; 219/724; 292/251.5; 200/50.02; 200/50.18

(58) Field of Search ..... 219/723, 724, 219/722; 292/251.5; 200/50.02, 50.18

(56) References Cited

U.S. PATENT DOCUMENTS 3,823,294 A * 7/1974 Takayama et al. ..... 219/274
4,497,993 A * 2/1985 Aoyama ..... 219/724
4,573,720 A * 3/1986 Nicolai ..... 292/144
4,638,137 A * 1/1987 Kazumi ..... 219/723
4,915,431 A * 4/1990 Bailey ..... 292/251.5

* cited by examiner

*Primary Examiner*—Philip H. Leung
(74) *Attorney, Agent, or Firm*—Cohen, Pontani, Lieberman & Pavane

(57) ABSTRACT

A normal position detecting mechanism for detecting a position of a functional component in a heating apparatus includes a drive member mounted on the functional component, a drive unit assembly mounted on the heating apparatus, and a switch for generating a detection signal. The driven unit assembly includes a switch actuating member, a bracket for supporting the switch actuating member, and a biasing member arranged between the mounting bracket and the switch. The biasing member applies a bias force for driving the switch actuating member against the direction for generating the detection signal. The drive member is positioned facing the switch actuating member when the functional component is in its normal position so that the drive member provides a force to move the switch against the biasing force to generate a detection signal.

6 Claims, 6 Drawing Sheets

NORMAL POSITION DETECTING AND LATCHING MECHANISM OF A FUNCTIONAL COMPONENT IN A HEATING APPARATUS

FIELD OF THE INVENTION

The present invention relates to a normal position detecting and latching mechanism of a functional component in a heating apparatus, such as a microwave oven, a microwave heating oven or the like.

DESCRIPTION OF THE PRIOR ART

As for most of microwave ovens, microwave heating ovens or the like, they have been configured such that functional members, for example, a turntable, a fan guard or the like are detachable for easy cleaning of the interior of a heating chamber. Accordingly, after having been washed, these functional members have to be placed back in their predetermined locations within the heating chamber. Consequently, there has been requested to install a certain mechanism for preventing such replacing from being failed forgetfully.

An example of such kinds of mechanisms according to the prior art is shown in FIGS. 6A and 6B of the accompanying drawings. This installed component detecting mechanism of the prior art, as shown in FIG. 6A, comprises a detective switch shaft 2 penetrating through an outer peripheral wall 1 of a heating chamber of a heating apparatus, and a limit switch 3 arranged outside the heating chamber so as to be located in a position facing to said detective switch shaft 2. When a specific functional member is not disposed inside the heating chamber 1, as shown in FIG. 6A, the detective switch shaft 2 is in a retracted position and thereby the limit switch 3 is in its inactivated condition, and, for example, such a caution may be given to indicate that the specified functional member is not installed in the predetermined location. As shown in FIG. 6B, when the functional member 4 is correctly installed in the heating chamber, said functional member 4 presses the detective switch shaft 2, which in turn brings the limit switch 3 to be actuated. Thereby, it can indicate that the specific functional member 4 is installed in the normal position.

Another example of such kinds of mechanisms according to the prior art is illustratively shown in FIG. 7. This conventional mechanism employs a proximity switch 5. The proximity switch generally has a detectable distance in a range of a few millimeters to some ten millimeters and is supposed to be used in an environment with a critical temperature of about 80° C. to 120° C. Based on above fact, in order to reduce the environmental temperature for the proximity switch and to make shorter a distance for detection, a recess 1A is formed in a portion of an outer peripheral wall 1 in a heating chamber, while a convex portion 6A is provided on a specified functional member 6, so that said convex portion 6A of the functional component 6 is allowed to fit into the recess 1A to bring the proximity switch to be actuated when the specific functional member is correctly installed in the heating chamber. That is, although the proximity switch 5 is located apart from the hole heating chamber in an operating environment with a temperature lower than the critical temperature, it still can detect whether there is the functional member or not within the detectable distance.

However, there have been the following problems with the conventional detecting mechanism described above with reference to FIG. 6. That is, since the detective switch shaft penetrates into the heating chamber, it is troublesome to clean the interior of the heating chamber. Further, because of a through hole, care must be taken upon washing with water. Dirt accumulation over the switch shaft 2 is likely to interfere with its driving and detective operation, resulting in a breakdown. Such an apparatus, for example, a microwave oven or a micro wave heating oven which performs a microwave heating needs preventive measures to be provided to the through hole to prevent the microwave leakage therethrough. Since the detective switch shaft 2 is in contact with the limit switch 3 during the heating apparatus is in use, the affection of heat transfer to the limit switch 3 via the functional member 4 within the heating chamber and the detective switch shaft 2 must be taken into account.

Further, there have also been the following problems with the conventional detecting mechanism described above with reference to FIG. 7. That is, forming the recess 1A in the outer peripheral wall of the heating chamber increase a man hour for manufacturing it, inevitably leading to the cost increase. If a concave or convex portion, such as the recess 1A is formed within the heating chamber wall, dirt is likely to accumulate therein or thereon and it is troublesome to clean it.

Accordingly, an object of the present invention is to provide a normal position detecting and latching mechanism of a functional component in a heating apparatus, which can solve the problems associated with the prior art as described above.

SUMMERY OF THE INVENTION

According to an aspect of the present invention, there is provided a normal position detecting mechanism of a functional component in a heating apparatus, comprising: a drive member mounted on said functional component side of said heating apparatus; a driven unit assembly mounted on a main body side of said heating apparatus; and a switch for generating a detection signal; said driven unit assembly comprising: a switch actuating member disposed in a back side of a flat wall surface of the main body side of said heating apparatus; a mounting bracket for operatively supporting said switch actuating member so as to be movable between said back side of the flat wall surface and said switch for generating the detection signal; and a bias member disposed between said mounting bracket and said switch actuating member, which applies a bias force for normally driving said switch actuating member against said switch for generating the detection signal; wherein said drive member is located in a position facing to said switch actuating member with said flat wall surface of said main body side of said heating apparatus sandwiched therebetween when said functional component is in its normal position in said heating apparatus, so that said drive member can provide a drive force to cause said switch actuating member to move in a direction away from said switch for generating the detection signal against the bias force of said bias member.

According to an embodiment of the present invention, said drive member is a magnet, and said switch actuating member is provided with another magnet having a different polarity from said magnet.

According to another embodiment of the present invention, said drive member is a magnet, and said switch actuating member is provided with an actuating iron core.

According to still another embodiment of the present invention, said switch for generating the detection signal is mounted on said mounting bracket.

According to another aspect of the present invention, there is provided a normal position detecting and latching mechanism of a functional component in a heating apparatus, comprising: a drive member mounted on said functional component side of said heating apparatus; a driven unit assembly mounted on a main body side of said heating apparatus; and a switch for generating a detection signal; said driven unit assembly comprising: a switch actuating member disposed in a back side of a flat wall surface of the main body side of said heating apparatus; a mounting bracket for operatively supporting said switch actuating member so as to be movable between said back side of the flat wall surface and said switch for generating the detection signal; and a bias member disposed between said mounting bracket and said switch actuating member, which applies a bias force for normally driving said switch actuating member against said switch for generating the detection signal; wherein said drive member is located in a position facing to said switch actuating member with said flat wall surface of said main body side of said heating apparatus sandwiched therebetween when said functional component is in its normal position in said heating apparatus, so that said drive member can provide a drive force to cause said switch actuating member to move in a direction away from said switch for generating the detection signal against the bias force of said bias member, as well as a latching force for bringing said functional component to be latched in said normal position.

According to one embodiment of the present invention, said drive member is a magnet, and said switch actuating member is provided with another magnet having a different polarity from said magnet, wherein a magnitude of magnetic force generated by both of said magnets is sufficient enough to provide a latching force so as to bring said functional component to be latched in the normal position by an attracting force generated between both magnets.

According to another embodiment of the present invention, said drive member is a magnet, and said switch actuating member is provided with an actuating iron core, wherein a magnitude of magnetic force generated by said magnet is sufficient enough to provide a latching force so as to bring said functional component to be latched in the normal position by an attracting force applied to said actuating iron core.

According to still another embodiment of the present invention, said switch for generating the detection signal is mounted on said mounting bracket.

According to still another embodiment of the present invention, said functional component is a door, and said switch for generating the detection signal serves as a door switch.

DESCRIPTION OF THE PREFERRED EMBODIMENTS

The present invention will now be described in detail with respect to preferred embodiments thereof in conjunction with the attached drawings especially with FIGS. 1 to 5.

Figure 1:
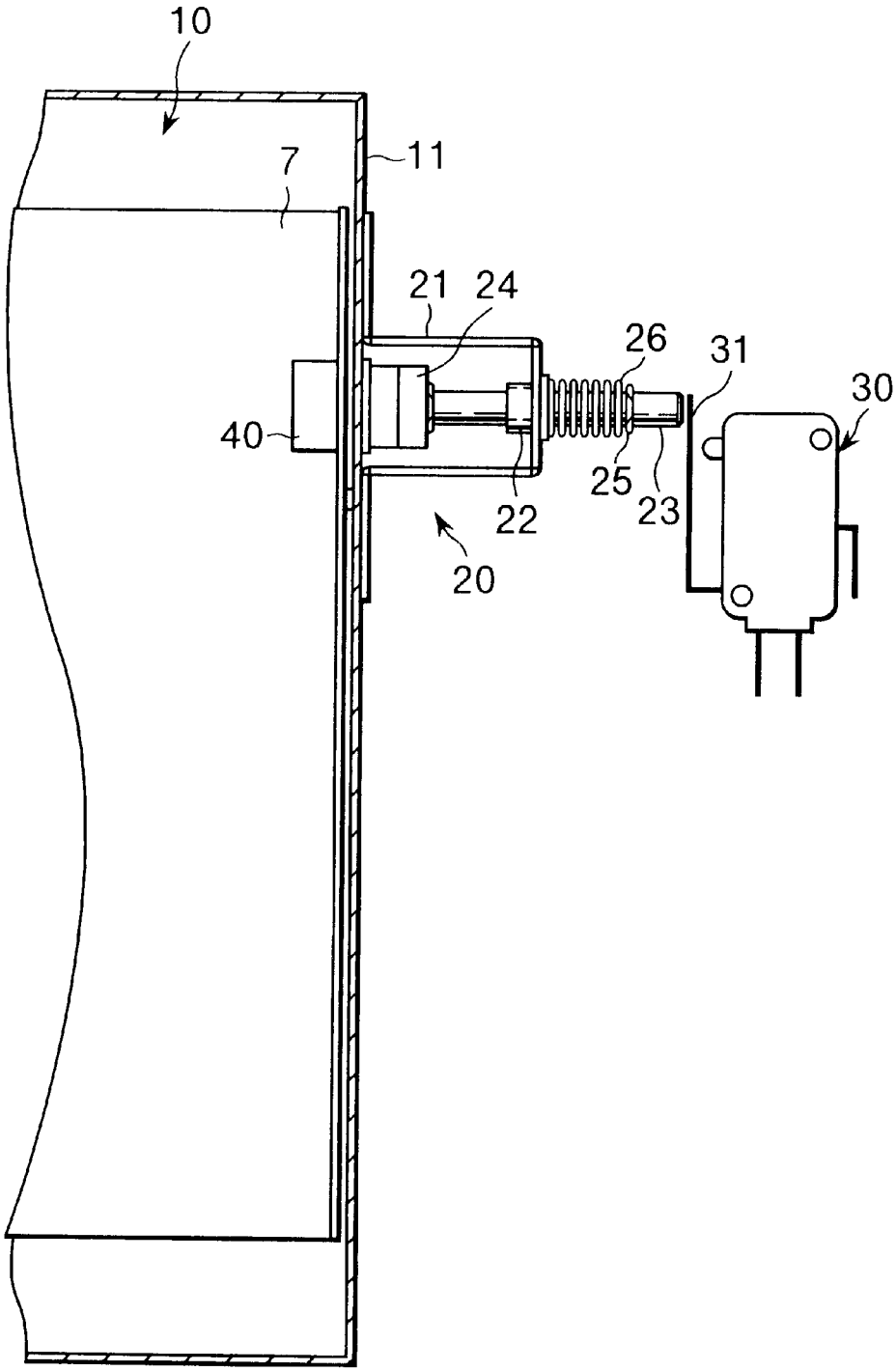
FIG. 1 is a schematic partial cross sectional view illustrating a normal position detecting mechanism of a fan guard in a heating apparatus according to an embodiment of the present invention, in a condition where the fan guard has been installed.
Figure 2:
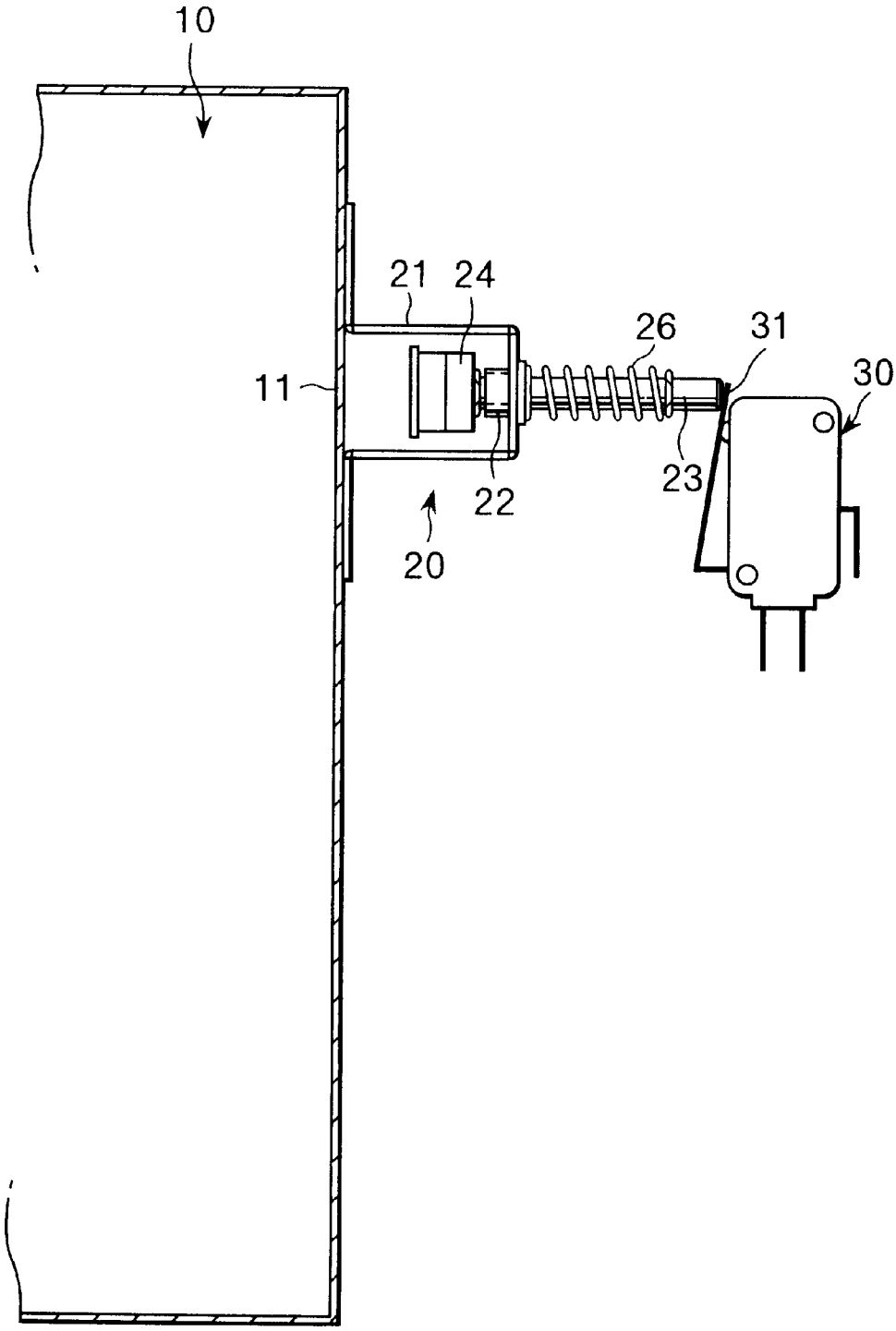
FIG. 2 is a schematic partial cross sectional view illustrating the normal position detecting mechanism of FIG. 1, in a condition where the fan guard has been removed.

FIG. 1 is a schematic partial cross sectional view illustrating a normal position detecting mechanism of a fan guard in a heating apparatus according to an embodiment of the present invention, in a condition where the fan guard has been installed, while FIG. 2 is a schematic partial cross sectional view illustrating the normal position detecting mechanism of FIG. 1, in a condition where the fan guard has been removed. As shown in these FIGS. 1 and 2, the normal position detecting mechanism of the fan guard of the present embodiment comprises: a plunger assembly 20 which is fixedly attached to an outer surface of an outer peripheral wall 11 of a heating chamber 10 of a heating apparatus, such as a microwave oven and a microwave heating oven; a micro switch 30; and a drive magnet 40 which is fixedly attached to a side edge of a mounting frame 7 of the fan guard. The plunger assembly 20 comprises: a bracket 21 which is fixedly attached to the outer surface of the outer peripheral wall 11 of non-magnetic material by using, for example, a screw; a plunger shaft 23 which is operatively mounted so as to be moved in an axial direction through a cylindrical guide portion 22 mounted on said bracket 21; a driven magnet 24 which is attached to one end of said plunger shaft 23; and a bias spring 26 which is disposed between a stopper portion 25 formed in the other end of said plunger shaft 23 and said bracket 21 so as to normally apply a bias force to said plunger shaft 23. The bias force of the bias spring 26 is applied in such a direction (in the right-hand direction in FIGS. 1 and 2) that the plunger shaft 23 is moved in the direction that the driven magnet 24 is retracted from a mounting base face of the bracket 21. Further, the drive magnet 40 and the driven magnet 24 are designed to have their polarities opposite to each other.

The micro switch 30 may be a general switch equipped with an action arm 31, and is fixedly installed in an outside of the outer peripheral wall 11 of the heating chamber 10 so that the action arm 31 may face to the plunger shaft 23.

An operation of the detection mechanism with such a configuration will now be described. First of all, let us assume that, in order to protect a blowing fan (not shown) which is normally located in a back face side of the heating chamber 10, a fan guard has been installed in a front face side of the blowing fan. At that time, as shown in FIG. 1, the mounting frame 7 of the fan guard is in the normal position within the heating chamber 10, and the drive magnet 40 attached to the side edge of the mounting frame 7 is in such a position where it faces to the driven magnet 24 attached to the one end of the plunger shaft 23 of the plunger assembly 20 mounted on the outer face of the outer peripheral wall 11 of the heating chamber 10. Accordingly, since the polarity of the driven magnet 24 is opposite to the polarity of the drive magnet 40, the driven magnet 24 is attracted by a magnetic force toward the drive magnet 40. This attracting force moves the plunger shaft 23 toward the outer peripheral wall 11 against the bias force of the bias spring 26. As a result, the other end of the plunger shaft 23 is moved to a position where it does not press the action arm 31 of the micro switch 30. In this situation, the micro switch is brought into inactivated condition, which indicates that the fan guard is in the normal position to serve as the functional component of the heating apparatus.

In the meantime as the heating apparatus is used under the condition where the fan guard is installed in the normal position, the interior of the heating chamber is getting dirty, so as the fan guard. Inevitably, when the need arises and the interior of the heating chamber and also the fan guard are to be cleaned, the fan guard is taken out of the inside of the heating chamber so that the interior of the heating chamber and the removed fan guard can be washed. Subsequently, upon using the heating apparatus again, the fan guard needs to be reinstalled in the normal position within the heating chamber, so that it is brought into the condition as shown in FIG. 1. However, in such a case where the fan guard was forgetfully not reinstalled or even after the reinstallation the fan guard was not successfully installed in the normal position, the detecting mechanism would be left in a condition as shown in FIG. 2.

In the condition as shown in FIG. 2, since there is no such component in the normal position within the heating chamber 10 that could apply a magnetic force to the driven magnet 24 of the plunger assembly 20, the plunger shaft 23 is moved by the bias force of the bias spring 26 in the direction away from the outer peripheral wall 11 and is held there to press the action arm 31 of the micro switch 30 to bring the micro switch 30 into an activated condition, thus indicating that the fan guard is not in the normal position for the functional component of the heating apparatus.

It should be appreciated that although in the above embodiment, the magnets, such as a drive magnet 40 and a driven magnet 24, have been employed, the present invention is not limited to this configuration, but either one of those magnets can be replaced with a piece of simple magnetic substance.

Figure 3:
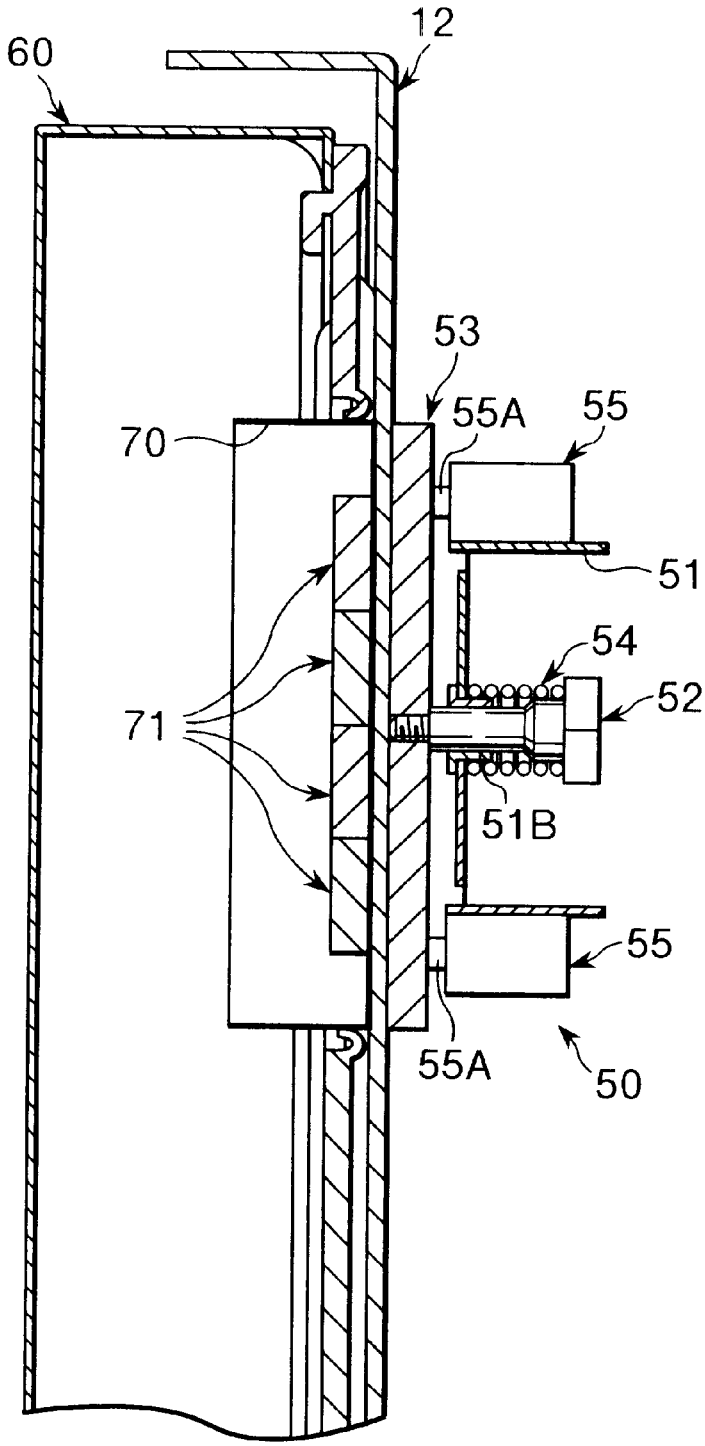
FIG. 3 is a schematic partial cross sectional view illustrating a normal position detecting mechanism of a door in a heating apparatus according to another embodiment of the present invention, in a condition where the door has been normally closed.
Figure 4:
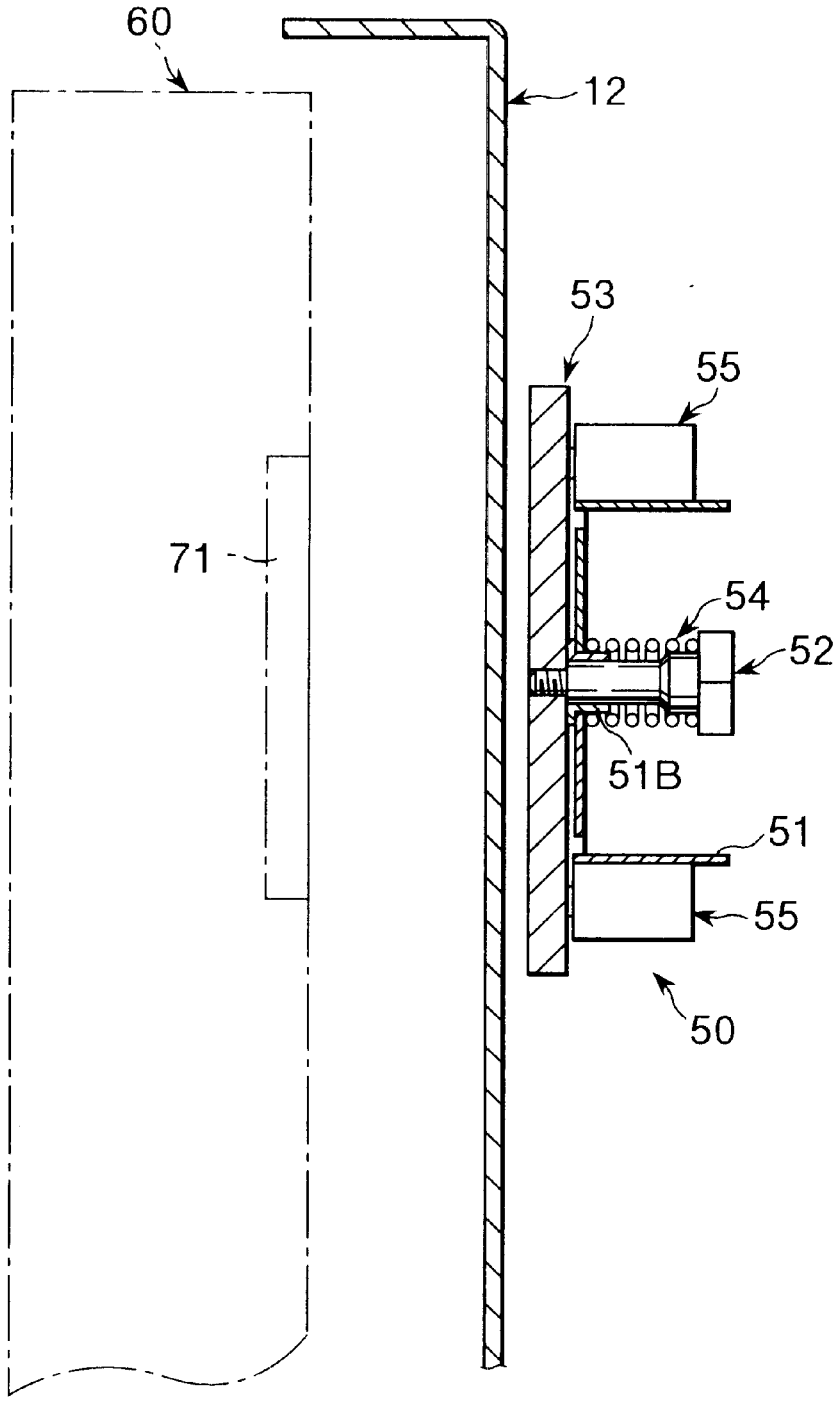
FIG. 4 is a schematic partial cross sectional view illustrating the normal position detecting mechanism of FIG. 3, in a condition where the door has not been completely closed.

FIG. 3 is a schematic partial cross sectional view illustrating a normal position detecting mechanism of a door in a heating apparatus according to another embodiment of the present invention, in a condition where the door has been normally closed, while FIG. 4 is a schematic partial cross sectional view illustrating the normal position detecting mechanism of FIG. 3, in a condition where the door has not been completely closed. As shown in FIGS. 3 and 4, the normal position detecting mechanism of the door in this embodiment comprises: a micro switch assembly 50 which is fixedly attached to an inner side of an edge frame 12 of an opening for providing an access to the inside of the heating chamber of the heating apparatus, such as a microwave oven and a microwave heating oven; and a drive magnet 71 which is located within a magnet case 70 arranged in an inner side edge portion of a door 60 for exposing or closing said opening of the heating chamber.

Figure 5:
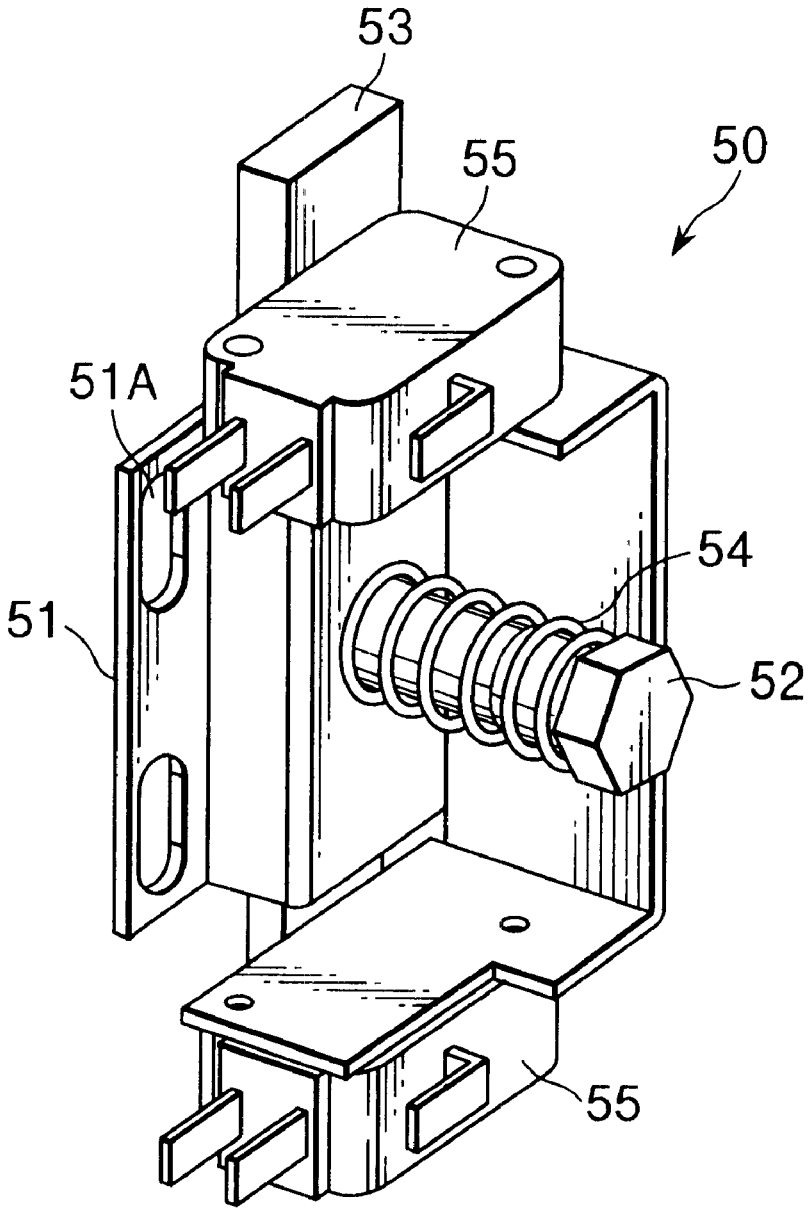
FIG. 5 is a perspective view of a micro switch assembly in the detecting mechanism of FIG. 3.
Figure 6A:
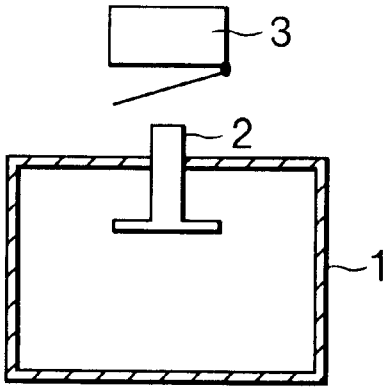
FIG.6A (PRIOR ART)
FIGS. 6A and 6B are schematic views of a detecting mechanism of an installed component according to an embodiment of the prior art.
Figure 6B:
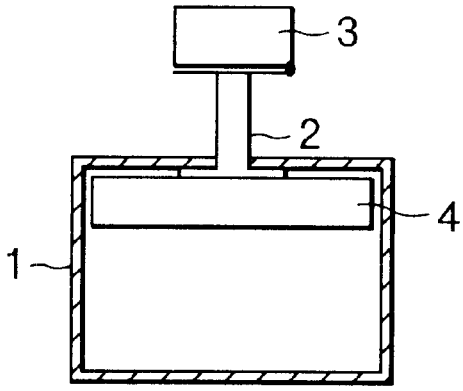
FIG.6B (PRIOR ART)
Figure 7:
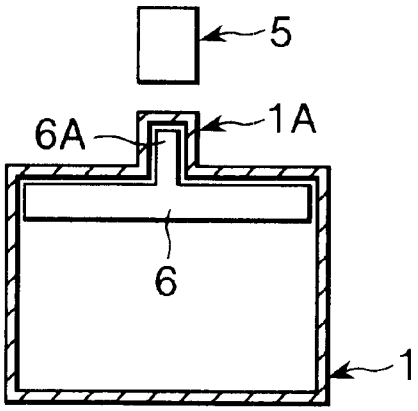
FIG.7 (PRIOR ART)
FIG. 7 is a schematic view of a detecting mechanism of an installed component according to another embodiment of the prior art.

FIG. 5 is a perspective view of the micro switch assembly 50. As best shown in FIG. 5, the micro switch assembly 50 comprises: a mounting bracket 51 having a hole 51A formed on a base portion for receiving a mounting screw; a shaft 52 movably inserted through a shaft bearing 51B (see FIGS. 3 and 4) attached to said mounting bracket 51; an actuating iron core 53 mounted on one end of said shaft 52; a bias spring 54 installed surrounding the shaft 52 between a head portion of the shaft 52 and a stepped portion of the mounting bracket 51; and a pair of micro switches 55 attached respectively to each of both arm portions of the mounting bracket 51. A bias force of the bias spring 54 is applied in such a direction (in the right-hand direction in FIGS, 3 and 4) that the shaft 52 is moved in the direction that the actuating iron core 53 is retracted from a mounting base face of the bracket 51.

An operation of the detecting mechanism with such a configuration will now be described. At first, in the condition where the door 60 has been completely closed as shown in FIG. 3, the drive magnet 71 mounted on the side edge of the door 60 is in such a position where it faces to the actuating iron core 53 mounted on the one end of the shaft 52 of the micro switch assembly 50 installed in the inner side of the edge frame 12 of the access opening of the heating chamber. Accordingly, the actuating iron core 53 is attracted by the magnetic force toward the drive magnet 71 against a bias force of the bias spring 54 so as to be moved away from the action piece 55A of the micro switch 55. Thereby, the micro switch 55 is brought into inactivated condition, and indicates that the door 60 has been completely closed.

However, in a case of operation where the door has been once opened and then closed again, let us assume that the door 60 has been failed to be closed completely, as shown in FIG. 4. In such a case, since the drive magnet 71 is located in a position distant from the actuating iron core 53 of the micro switch assembly 50, the magnetic force of the drive magnet 71 would not affect the actuating iron core 53. Accordingly, the actuating iron core 53 is moved by the bias force of the bias spring 54 in the direction away from the inner side face of the edge frame 12 and is held there to press the action piece 55A. Thereby, the micro switch 55 is activated, and indicates that the door 60 has not been completely closed.

Although the normal position detecting mechanism in the above two embodiments has been described as a functional mechanism for detecting exclusively whether or not the functional component of the fan guard or the door is in its normal position, a similar mechanism may be adapted to include a latching function, in addition to a normal position detecting function, of the functional component for bringing the functional component to be latched in a normal position by appropriately setting a magnitude of a magnet to be used. Such a normal position detecting and latching mechanism will now be briefly described in accordance with the configuration shown in FIGS. 3 to 5. In a condition where the door 60 has been completely closed as shown in FIG. 3, the normal position detecting mechanism could be adapted to carry out, in addition to the function of normal position detecting, the function of latching the door by selecting a magnitude of the drive magnet 71 so that an attracting force of the drive magnet 71 applied to the actuating iron core 53 can provide a sufficient force for the door to be latched in the fully closed position. In this situation, the micro switch 55 can also serve as a door switch so as to indicate that the door 60 has been latched in the fully closed position.

Similarly, it is also possible for the mechanism as shown in FIGS. 1 and 2 to serve also as a latching mechanism by selecting appropriately the magnitude of the magnetic force to be generated by the magnets 40 and 24.

Since such latching mechanism needs no additional component to be installed for latching, it can make the configuration thereof much simpler and less expensive, and further, since this latching mechanism needs no concave portion nor through hole to be formed in the outer peripheral wall or in the edge frame wall of the heating chamber which is exposed and closed by the door, therefore there would be no concern over the dirt to accumulate in the concave portion or the though hole, and also the cleaning thereof would be carried out more easily.

It should be noticed that, although in the above embodiment the micro switch has been employed, a modification may be applied to use a proximity switch, an optical sensor or the like as a substitute for the micro switch.

Since there is no need for an inner wall portion of a heating chamber to be provided with concave and convex portions or a through hole, the cleaning of the interior of the heating chamber is facilitated, and also there is no concern over micro wave leakage.

In a configuration according to the present invention, a heat transfer path to a micro switch is blocked when a heating apparatus is under operation, which can eliminates a thermal affection to the micro switch.

Since the normal position detecting mechanism according to the present invention may be easily modified to serve also as a latching mechanism without no additional component installed for the latching mechanism, the mechanism for both purpose may be made much simpler and less expensive.

Since there is no need for forming any concave portion or through hole in a housing or a door of a heating apparatus in order to add a latching mechanism, the heating apparatus could be provided with advantages in that the dirt is hard to accumulate and thereby the cleaning may be carried out easily.

What is claimed is:

1. A position detecting mechanism for detecting when a functional component is in its normal position relative to a heating apparatus having a main body including a flat wall surface, comprising:

a drive member adapted to be mounted on the functional component;

a driven unit assembly adapted to be mounted on the flat wall surface of the heating apparatus; and a switch for generating a detection signal;

said driven unit assembly comprising:

a switch actuating member adapted to be disposed on one side of the flat wall surface of the heating apparatus;

a mounting bracket for operatively supporting said switch actuating member so as to be movable between the flat wall surface and said switch for generating the detection signal; and a bias member disposed between said mounting bracket and said switch actuating member, which applies a bias force for normally driving said switch actuating member against said switch for generating the detection signal;

wherein said drive member is adapted to be located in a position facing said switch actuating member with the flat wall surface of the heating apparatus sandwiched therebetween when said functional component is in its normal position in the heating apparatus, so that said drive member can provide a drive force to cause said switch actuating member to move in a direction away from said switch for generating the detection signal against the bias force of said bias member; and wherein said drive member is a magnet and said switch actuating member is provided with an actuating iron core.

2. A position detecting mechanism in accordance with claim 1, in which said switch for generating the detection signal is mounted on said mounting bracket.

3. A position detecting and latching mechanism for detecting when a functional component is in a normal position relative to a heating apparatus having a main body including a flat wall surface, comprising:

a drive member adapted to be mounted on the functional component;

a driven unit assembly adapted to be mounted on the flat wall surface of the heating apparatus; and a switch for generating a detection signal;

said driven unit assembly comprising:

a switch actuating member adapted to be disposed on one side of the flat wall surface of the heating apparatus;

a mounting bracket for operatively supporting said switch actuating member so as to be movable between the flat wall surface and said switch for generating the detection signal; and a bias member disposed between said mounting bracket and said switch actuating member, which applies a bias force for normally driving said switch actuating member against said switch for generating the detection signal;

wherein said drive member is adapted to be located in a position facing said switch actuating member with said flat wall surface of the heating apparatus sandwiched therebetween when the functional component is in its normal position in the heating apparatus, so that said drive member can provide a drive force to cause said switch actuating member to move in a direction away from said switch for generating the detection signal against the bias force of said bias member, as well as a latching force for bringing said functional component to be latched in said normal position; and wherein said drive member is a magnet and said switch actuating member is provided with an iron core, wherein a magnitude of magnetic force generated by said magnet sufficient to provide a latching force so as to bring the functional component to be latched in the normal position by an attracting force applied to said actuating iron core.

4. A position detecting and latching mechanism in accordance with claim 3, in which said switch for generating the detection signal is mounted on said mounting bracket.

5. A position detecting and latching mechanism in accordance with claim 4, in which the functional component is a door, and said switch for generating the detection signal serves as a door switch.

6. A position detecting and latching mechanism in accordance with claim 3, in which the functional component is a door, and said switch for generating the detection signal serves as a door switch.

* * * * *